United States Patent [19]

Crooks

[11] 4,139,939

[45] Feb. 20, 1979

[54] UTILITY KNIFE

[75] Inventor: George C. Crooks, Sturbridge, Mass.

[73] Assignee: Hyde Manufacturing Company, Southbridge, Mass.

[21] Appl. No.: 849,081

[22] Filed: Nov. 7, 1977

[51] Int. Cl.[2] ..... B26B 1/08

[52] U.S. Cl. ..... 30/2; 30/162

[58] Field of Search ..... 30/162, 2, 293, 320

[56] References Cited

U.S. PATENT DOCUMENTS

| | | | |
|---|---|---|---|
| 2,550,346 | 4/1951 | Gregg | 30/162 X |
| 2,862,296 | 12/1958 | Anderson | 30/162 |
| 3,906,627 | 9/1975 | Manning | 30/162 |

FOREIGN PATENT DOCUMENTS

| | | | |
|---|---|---|---|
| 671327 | 10/1963 | Canada | 30/162 |

*Primary Examiner*—Jimmy C. Peters

*Attorney, Agent, or Firm*—Charles R. Fay

[57] ABSTRACT

An utility knife comprising a two part housing, a slidable blade therein, means restricting the blade to a relatively small projection from the housing, spring means normally retracting the blade to fully housed condition within the housing, an exterior thumb piece to slide the blade, frangible means on the thumb piece acting as a stop which when removed allows the blade to project to a greater degree, and means for holding a spare blade in the casing.

10 Claims, 5 Drawing Figures

UTILITY KNIFE

BACKGROUND OF THE INVENTION

There have been many utility knives provided in the prior art. Such knives usually comprise or include a two part housing secured together by a screw and having a slidable blade therein with an external thumb piece connected to a carriage for the blade to slide it in and out of the casing at an end thereof for the purpose of opening cartons and the like. However, the knives commonally utilized are originally almost as sharp as a razor, and such knives are found to be dangerous and may accidentally cut the person using the knife because of the fact that once the blade is projected to the degree desired, it stays in this exposed position until it is deliberately manually retracted. It is the object of the present invention to provide a safety utility knife in which the blade is normally housed completely and is only projected and held in projected form by the thumb of the user when in use, there being a spring to retract the blade upon release of the external thumb piece.

SUMMARY OF THE INVENTION

The safety utility knife of the present invention comprises two complimentary halves forming a complete casing, the halves being secured together by a single screw or similar fastener. One half of the casing at the inside thereof has a relatively short guideway in which a flat piece of material is slidingly guided and is normally retracted by means of a spring. A thumb piece extends through an aperture in the wall of the same half casing and this has a substantially permanent connection with respect to said flat piece. Said thumb piece is located in a recessed area, one end of which forms a stop for the thumb piece so that it can only be moved say for instance a quarter or five sixteenth of an inch, which limits the projection of the blade mounted on the flat piece of material to a projection of a like amount from the casing.

However, the projection to this extent is sufficient for opening most cartons, i.e. cutting tape, severing cords, strings, etc. and is also useful for other purposes where the knife is useful when restricted to a projection as stated.

The thumb piece in the present case is provided with a frangible tab or projection which acts as a stop limiting the projection of the blade as aforesaid; or when broken off, this tab will then allow the projection of the blade to a greater extent should this be desired.

The other casing half is provided with an outstanding pin interiorally thereof upon which may be mounted one or more spare blades, the spare blades being provided with square apertures thereto for engagement with the interior projection on the thumb piece, and there is provided an elastomeric ring having a central opening therein such as to temporarily grasp the pin on which the spare blade or blades are mounted, holding the same in fixed position within the housing.

PREFERRED EMBODIMENT OF THE INVENTION

Figure 1:
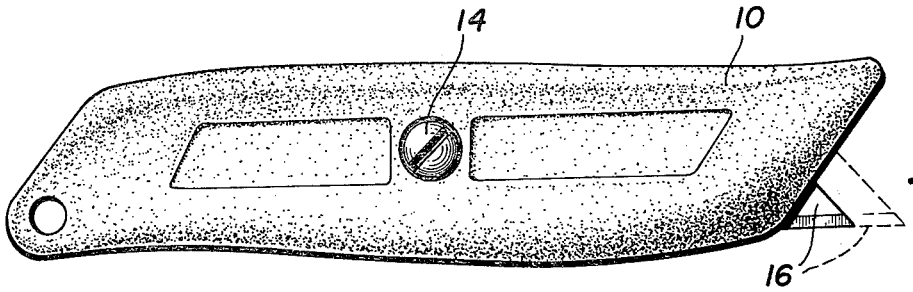
FIG. 1 is a view in elevation of one side of the utility knife of the present invention and illustrating the maximum projection of the knife blade.
Figure 2:
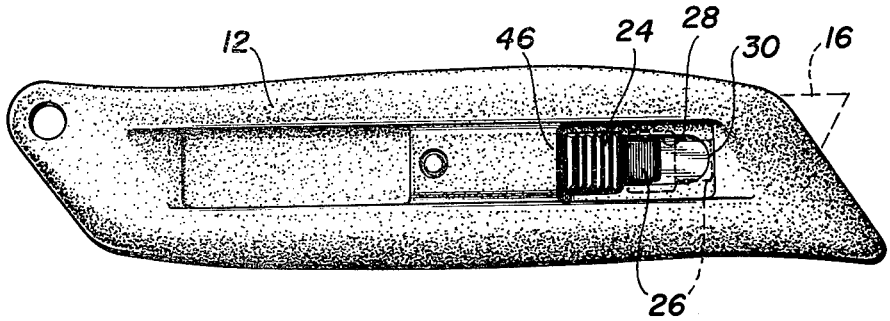
FIG. 2 is a view in elevation showing the other side aspect of the housing including the thumb piece.
Figure 3:
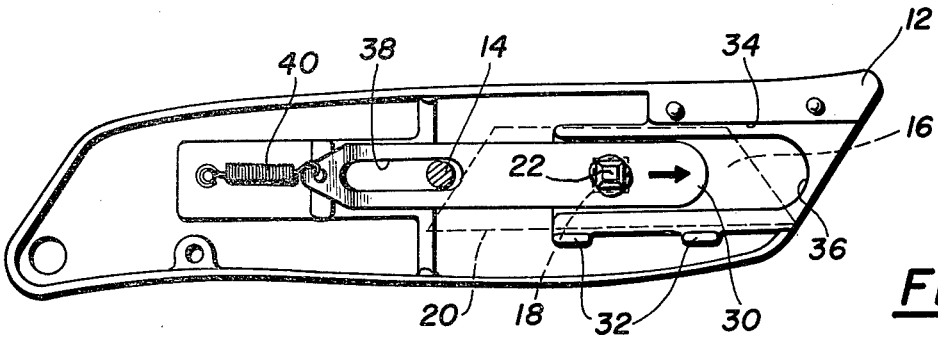
FIG. 3 is an interior view of the casing half illustrated in FIG. 2.

As shown in FIGS. 1 and 2 there is provided a casing made of half parts 10 and 12, and the half part 10 shown at the exterior thereof is provided with an opening to receive a screw 14 securing the parts together, this screw also being indicated in FIG. 3. The blade is indicated at 16 and under the condition of the presence of the frangible tab, to be later described, is limited to a projection as shown in solid lines, FIG. 1, but with the frangible tab removed the blade can then be extended to the dotted line position.

The blade 16 is indicated in dotted lines in FIG. 3. It has a square opening 18 centrally located therein and a sharp cutting edge 20.

The square opening 18 in the blade 16 is for mounting on the interior square post 22 integral with the exterior thumb piece 24 having the forwardly extending tab 26. The thumb piece is movable between the solid and dotted lines position shown in FIG. 2, and works in a slot 28 having an end 30 stopping the tab 26 in the dotted line position in FIG. 2, to prevent the knife blade extending any further outwardly then as shown in solid lines in FIG. 1 and dotted lines in FIG. 2.

The thumb piece extends through the slot 28 into the interior of the casing so that the post 22 extending through a flat member 30 (blade carrier) moves the same as guided by upright guide ridges 32 and 34. The guide ridges terminate in an internal edge 36 and it will be seen that this, therefore, guides member 30 in a rectilinear motion in the direction of the arrow in FIG. 3, flat member 30 also being guided by the screw or other fastener 14 which extends through a longitudinal slot 38 therein. A spring 40 normally holds the member 30 in the retracted position shown in FIG. 3, with the blade completely housed in the casing.

The blade obtains further guiding by means of raised ribs 42, 44 in the half of the casing which is indicated at 12.

The reference numeral 46 indicates an outwardly projecting exterior stop which is integral with the casing half 12 and this, of course, prevents the thumb piece 24 and the blade carrier 30 from moving any farther to the rear under influence of the spring.

Figure 4:
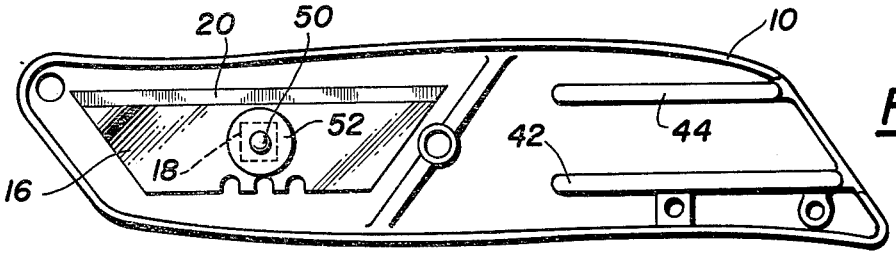
FIG. 4 is a view similar to FIG. 3 but showing the interior of the casing half shown in FIG. 1.
Figure 5:
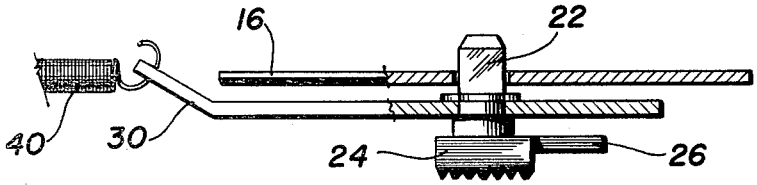
FIG. 5 is a greatly enlarged view illustrating the thumb piece, its attachment with relationship to the blade and the frangible tab thereon.

In the casing half 10 there is provided a post 50 on which may be held a spare blade or blades 16 and an elastomeric washer or ring or the like 52 slips over the post 50 in close association therewith to hold the blade in the fixed position shown in FIG. 4.

If a greater projection of the knife edge is desired it is an easy matter to slip a screw driver tip under the frangible tab 26 and break it off so that thereafter the thumb piece 34 itself becomes the stop in engaging the end of slot 28, and in this case the blade can then be projectible to the dotted line position shown in FIG. 1.

I claim:

1. A utility knife comprising a housing, a slidable blade therein, an opening in said housing, means aligning the slidable blade within said opening, means at the exterior of the housing adjacent the blade, said means being slidable and adapted to slide said blade partially out of said housing to an operable position, and means inside the housing normally maintaining said blade in inoperative fully housed position, wherein the means outside the housing for sliding the blade comprises a thumb piece, a forwardly projecting stop on the thumb piece, and means for engagement by said stop to limit the motion of the thumb piece and, therefore, of said blade.

2. The utility knife of claim 1 wherein said stop on the thumb piece is removable, the thumb piece then acting as a stop, and providing for additional extension of said blade from the housing in operative position thereof.

3. The utility knife of claim 2 wherein said removable stop comprises a frangible tab extending from said thumb piece.

4. The utility knife of claim 1 including means in the housing carrying the blade, said means comprising a flat member, and longitudinal ribs guiding the flat member longitudinally.

5. The utility knife of claim 4 wherein the means normally maintaining the blade within the housing comprises a resilient member attached to said flat member and normally withdrawing it in a direction to completely house the blade within the housing, and wherein the slidable means at the exterior of the housing comprises a thumb piece, an inwardly projecting member on the thumb piece, and a corresponding aperture in the flat member receiving the projecting member.

6. A utility knife comprising a housing including two complementary parts, means securing the two parts together, one of said parts including guide means, a flat plate longitudinally guided by said guide means, a spring maintaining said flat plate in a predetermined position, a thumb piece at the exterior of said housing, means mounting said thumb piece for rectilinear motion thereon, means for connecting the thumb piece with respect to said flat plate for moving the flat plate thereby, a blade, means on the flat plate for the reception and connection of the blade with respect thereto, a slot at an edge of said housing, said blade being normally housed completely within the housing under influence of said spring and being partially projected therefrom through said slot through the action of said thumb piece, a forwardly extending tab on said thumb piece, means acting as a stop to limit the motion of the thumb piece by engagement with the forward end of said tab, said tab being removable from the thumb piece to allow a greater slidable motion of the thumb piece and therefore of the flat plate and of the blade to extend the blade to a greater extent through said slot.

7. The utility knife of claim 6 including a pin at the interior of said housing, an extra blade having a central opening therein engageable over the pin, and an elastomeric ring or the like for engagement with said pin holding said blade in fixed position in said housing.

8. The utility knife of claim 7, wherein the guide means for the flat plate is on one part of the housing at the interior thereof, the other part of the housing including guide means for said blade, the blade being mounted relatively loosely on said flat plate.

9. A utility knife comprising a pair of generally hollow complementary parts, the parts being correspondingly elongated, a guide on one of said parts internally thereof, a generally flat plate mounted to slide rectilinearly on the guide, an aperture in said flat plate, means for normally retracting said flat plate, a slidable thumb piece exterior of said housing, said thumb piece having a projection thereon extending through a slot in a knife part into said housing, said projection being engaged in the aperture in said flat plate for moving the flat plate in its rectilinear motion under influence of the thumb piece, means limiting the motion of the thumb piece, a blade mounted on said projection and movable with said flat plate under influence of said thumb piece, means retracting the flat plate normally holding said blade completely housed in the housing, said thumb piece actuating said flat plate on said blade to project said blade partially through a second slot in said housing, said blade having a sharpened edge and a point at one end thereof, said blade extending only partially from the housing under influence of said thumb piece, and the blade being wholly retracted within said housing merely upon release of the thumb piece.

10. A utility knife comprising a pair of generally hollow complementary parts, the parts being correspondingly elongated, a guide on one of said parts internally thereof, a generally flat plate mounted to slide rectilinearly on the guide, means for normally retracting said flat plate, a slidable thumb piece exterior of said housing, said thumb piece having a projection extending through a slot into said housing, said projection being engaged with the said flat plate for moving the flat plate in its rectilinear motion under influence of the thumb piece, means limiting the motion of the thumb piece, a blade mounted on said projection and movable with said flat plate under influence of said thumb piece, means retracting the flat plate normally holding said blade completely housed in the housing, said thumb piece actuating said flat plate on said blade to project said blade partially through a second slot in said housing, said blade having a sharpened edge and a point at one end thereof, said blade extending only partially from the housing under influence of said thumb piece, and the blade being wholly retracted within said housing upon release of the thumb piece, a forwardly extending tab on said thumb piece, a stop which is formed by the end of the slot through which the projection extends, and limiting the degree of sliding action of said thumb piece, the tab being frangible and when broken off from said thumb piece allowing an extra motion of the flat plate and the blade with respect to said housing so the blade extends to a greater extent than when the tab was in place on the thumb piece.

* * * * *